US007591122B2

(12) United States Patent
Monti

(10) Patent No.: US 7,591,122 B2
(45) Date of Patent: Sep. 22, 2009

(54) DEVICE FOR FEEDING A BLISTER BAND WITH VARIOUS ARTICLES, SUCH AS PILLS, CAPSULES, TABLETS

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 279 days.

(21) Appl. No.: 11/584,844

(22) Filed: Oct. 23, 2008

(65) Prior Publication Data

US 2007/0095716 A1 May 3, 2007

(30) Foreign Application Priority Data

Oct. 28, 2005 (IT) ..... BO2005A0657

(51) Int. Cl.
*B65B 5/10* (2006.01)
*B65B 35/10* (2006.01)

(52) U.S. Cl. ..... 53/246; 53/248

(58) Field of Classification Search ..... 53/559, 53/561, 244–248, 255; 221/131, 171, 172
See application file for complete search history.

(56) References Cited

U.S. PATENT DOCUMENTS

| | | | | |
|---|---|---|---|---|
| 1,295,971 | A * | 3/1919 | Davis | 221/131 |
| 1,715,968 | A * | 6/1929 | Weber et al. | 53/246 |
| 2,833,095 | A * | 5/1958 | Stuart | 53/246 |
| 2,834,169 | A * | 5/1958 | Stuart | 53/246 |
| 3,650,083 | A * | 3/1972 | Riley | 53/244 |
| 3,703,232 | A * | 11/1972 | Zbiegien | 221/171 |
| 3,759,011 | A | 9/1973 | Vambola | |
| 3,775,941 | A * | 12/1973 | Bross | 53/559 |
| 3,789,575 | A * | 2/1974 | Bross | 53/246 |
| 3,820,301 | A * | 6/1974 | Willsey | 53/246 |
| 5,239,807 | A * | 8/1993 | Soleri | 53/244 |
| 5,310,300 | A * | 5/1994 | Crabb et al. | 53/246 |
| 6,206,234 | B1 * | 3/2001 | Rawlins | 221/131 |

FOREIGN PATENT DOCUMENTS

| | | | |
|---|---|---|---|
| DE | 2 239 344 | | 2/1974 |
| EP | 1 391 386 | A2 | 2/2004 |
| EP | 1 557 381 | A1 | 7/2005 |
| EP | 1 588 944 | A1 | 10/2005 |
| FR | 2391916 | A * | 12/1978 |
| JP | 03000618 | A * | 1/1991 |
| JP | 05085519 | A * | 4/1993 |

* cited by examiner

*Primary Examiner*—Stephen F Gerrity
(74) *Attorney, Agent, or Firm*—William J. Sapone; Coleman Sudol Sapone P.C.

(57) ABSTRACT

A device feeds a blister band, moved in a forward direction, with articles, supplied by gravity through a plurality of channels situated above the band. Each channel has a radial unit with radial needles entering the channel to hold a lowermost article. Rotation of the radial unit makes the lowermost article to go resting on a rotating element situated below and provided with arms also entering the channel to receive the article released and drop it into a blister of the blister band.

12 Claims, 6 Drawing Sheets

DEVICE FOR FEEDING A BLISTER BAND WITH VARIOUS ARTICLES, SUCH AS PILLS, CAPSULES, TABLETS

FIELD OF THE INVENTION

The present invention relates to blistering machines, with particular reference to devices for introducing articles, such as pills, capsules, tablets into the blisters of a blister band.

DESCRIPTION OF THE PRIOR ART

In some types of blistering machines the articles are released in a gravity-induced controlled way through a plurality of channels, into corresponding blisters of a blister band moved by conveying means.

The blister band usually has identical rows of blisters, arranged one beside another, crosswise with respect to the longitudinal direction, and is driven toward an article filling station, which includes a plurality of inclined channels, whose number is at least equal to the number of blisters of one row. The channels are situated above the passing band so that the articles fed by falling through the channels, are guided by the shape of the latter along a given section into corresponding blisters.

A shutter device for each channel interacts with the articles contained therein so as to release only one article at a time into a corresponding blister while the other articles are held, when a row of blisters passes therebelow.

A device of this type includes for example two elements, a lower one and an upper one, operated alternately to act inside the associated channel at a reciprocal distance at least equal to the longitudinal dimension of an article.

Each of the above elements moves between an active configuration, in which they cause an interference within the channel, so that an article goes in abutment against the element and consequently holds all the articles thereabove, and a rest configuration in which no interference is caused and the article is released.

In this sense, holding of a first article as well as all the ones thereabove (respectively second article, third article, etc.) by the lower abutment element set in active configuration, is followed by deactivation of the latter and activation of the upper abutment element to allow the first article to be released into a corresponding blister below and the second and further articles to be held by the upper abutment element.

However, the just described cycle is a source of such a quantity of stresses for a single article that sometimes they cause damages to the article and consequently the rejection of the corresponding package (unitary portion of the blister band known as "blister pack") by control means.

Such stresses occur in every step of the cycle and can be attributed in particular to: the fall path executed by the article released by the lower element up to the corresponding blister; the motion of the articles within the associated channel, characterized by continuous leaps of the articles caused by the alternate movement of the lower and upper elements; the activation of the upper element, which fits in between two articles and thus can jeopardize their integrity.

The above disadvantages result extremely inconvenient for such articles as tablets, which are more friable with respect to the most widespread ones, because they are produced in a way as to facilitate their melting in the mouth.

Obviously, in this application the shutter devices are strongly unadvisable.

SUMMARY OF THE INVENTION

In the light of what above, the object of the present invention is to propose a device for feeding a blister band with various articles, such as tablets, capsules, pills, which is compatible also with the tablet products, made more friable to facilitate their oral taking.

In this sense, the above object is fulfilled by proposing a device which allows to release articles into blisters of the blister band in a controlled way, such as not to jeopardize the articles physical integrity, which is thus reliable, efficient, functional and suitable for any type of tablet being used, from the most compact to the most friable.

Moreover, a further object of the present invention is to propose a device for feeding a blister band with various articles, such as tablets, capsules, pills, whose cost is adequate to the desired results.

The above mentioned objects are obtained, in accordance with the contents of the claims, by a device for feeding a blister band with various articles, such as tablets, capsules, pills, the blister band being driven in a prefixed feeding direction and with said articles supplied by gravity through a plurality of channels situated above the band, said device including:

holding means for each channel of said channels, for holding a first article and supporting articles situated above said first article, said means being operated to release said first article and to hold a second article, situated above the first article;

receiving and releasing means for each channel of said channels, situated between said blister band and said holding means and operated in step relation with said holding means as well as with the motion of said blister band in said feeding direction, for receiving an article released by said holding means and drop said received article into a blister of said blister band.

BRIEF DESCRIPTION OF THE DRAWINGS

The characteristic features of the invention, not resulting from what has been just said, will be better pointed out in the following, in accordance with the claims and with the help of the enclosed figures, in which:

DESCRIPTION OF THE PREFERRED EMBODIMENTS

Figure 1:
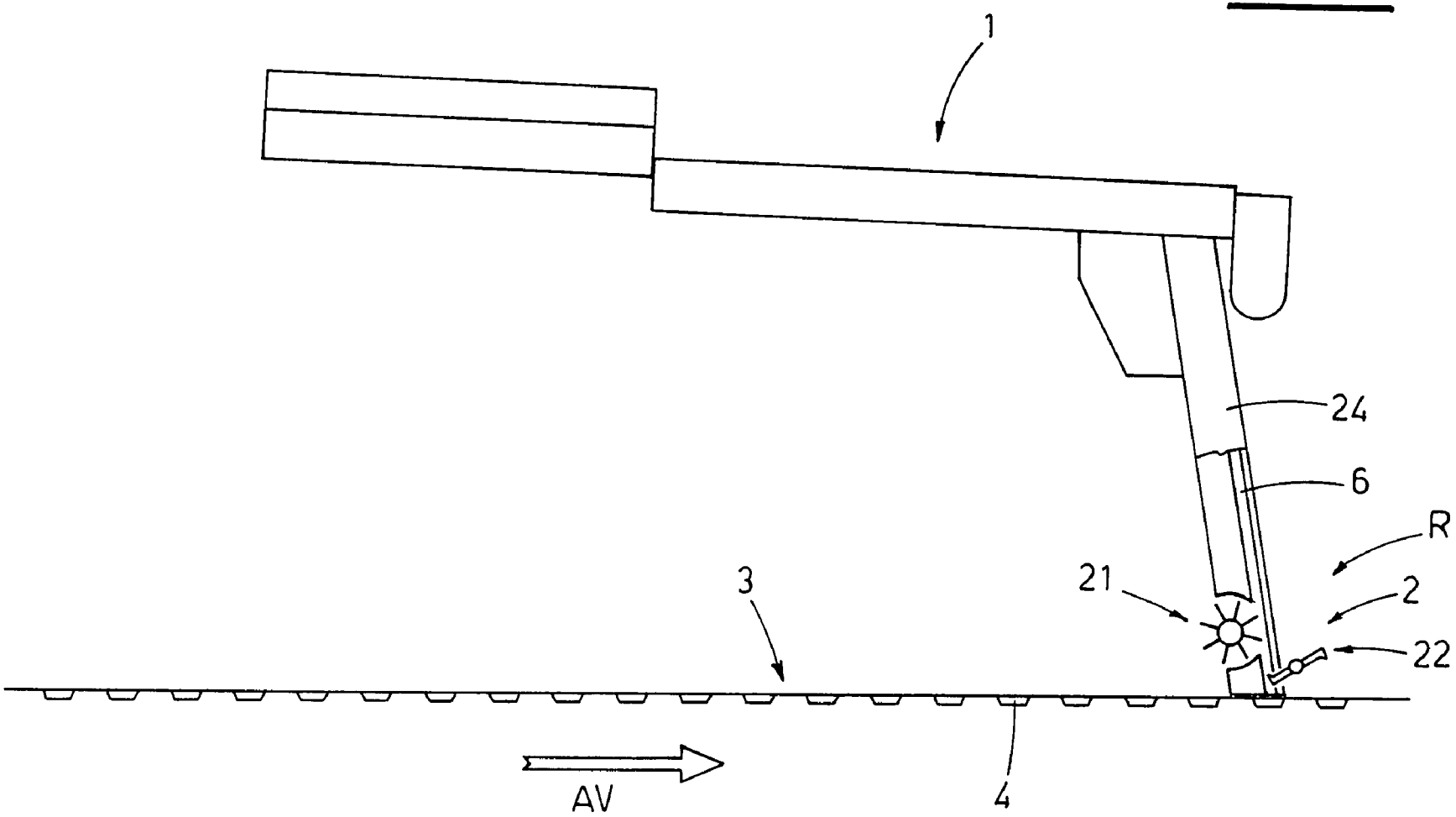
FIG. 1 is a schematic, lateral view of a significant part of a blistering machine, including the device proposed by the invention.

With reference to the enclosed Figures, a blistering machine 1 is shown (FIG. 1), which includes the feeding device 2, proposed by the invention.

The machine 1 has been shown only partially, in those parts considered the most relevant to the invention.

A blister band 3 is moved continuously by conveying means, not shown, with a given forward speed and in a forward direction AV; the band is horizontal and with its axis parallel to the forward direction.

Figure 3:
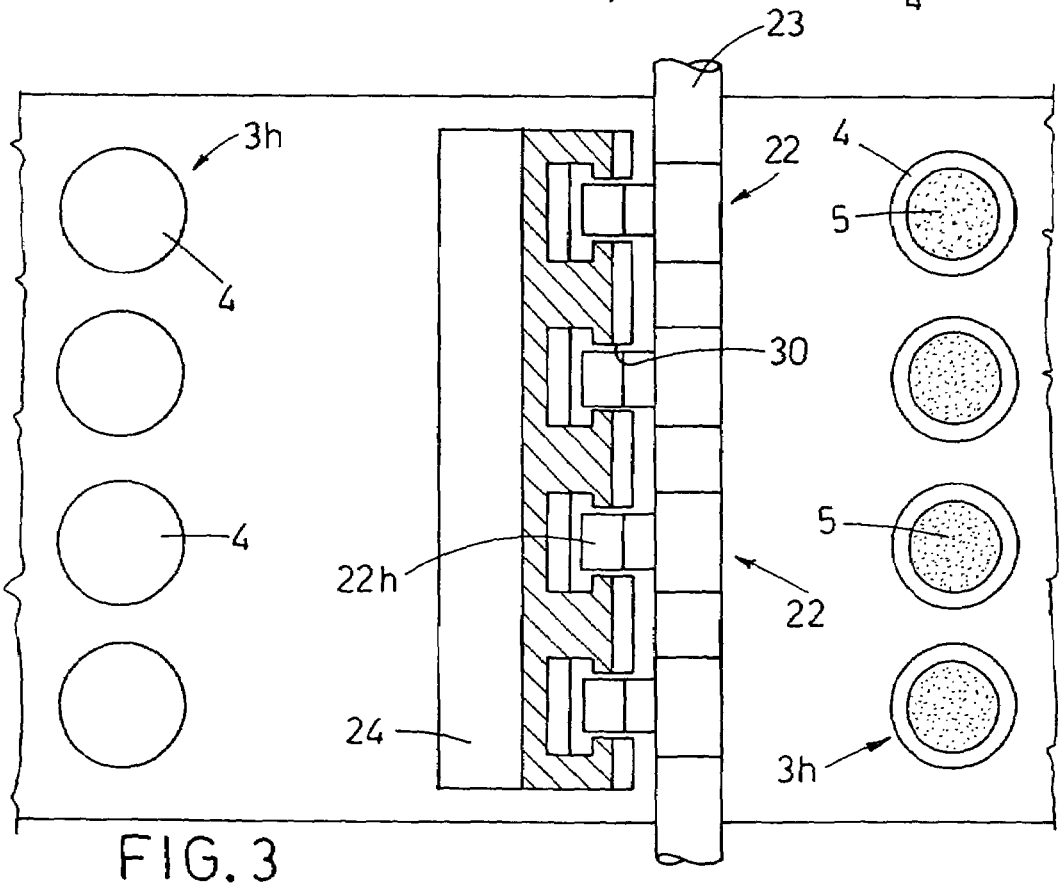
FIG. 3 is a section view taken along the line III-III of FIG. 2.

In the shown example, the band has identical rows 3*h* of blisters 4, arranged crosswise to the forward direction (see FIG. 3 as an indication).

A plurality of inclined channels 6, carried by a stationary framework 24, integral with the machine 1 structure, is situated in a station R and above the band 3 for filling the blister band 3 with various articles 5, 5A, 5B, 5C, for example tablets.

The articles 5, 5A, 5B, 5C in a row are fed by gravity one after another through the channels 6, where they slide in a direction parallel to their longitudinal axis, and are handled by the feeding device 2 of the blister band 3, interposed between the band 3 and the channels 6.

Figure 9:
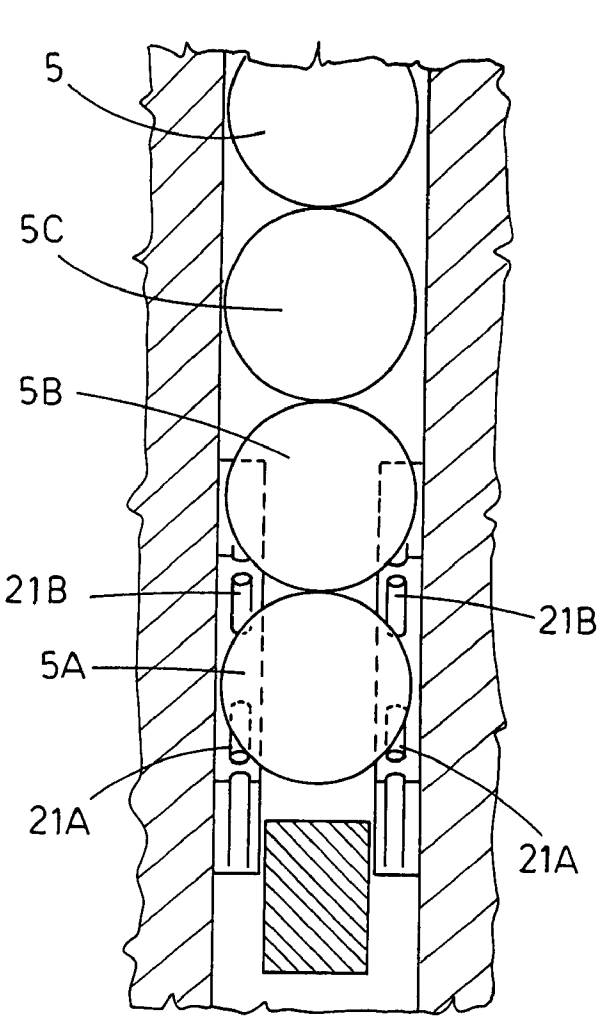
FIG. 9 is an enlarged, section view taken along the line IX-IX of FIG. 8.
Figure 5:
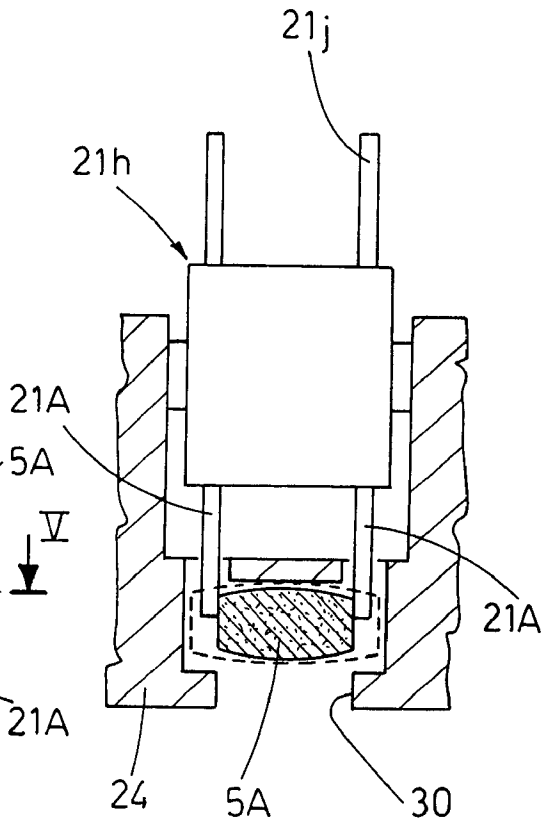
FIG. 5 is a section view taken along the line V-V of FIG. 4.
Figure 4:
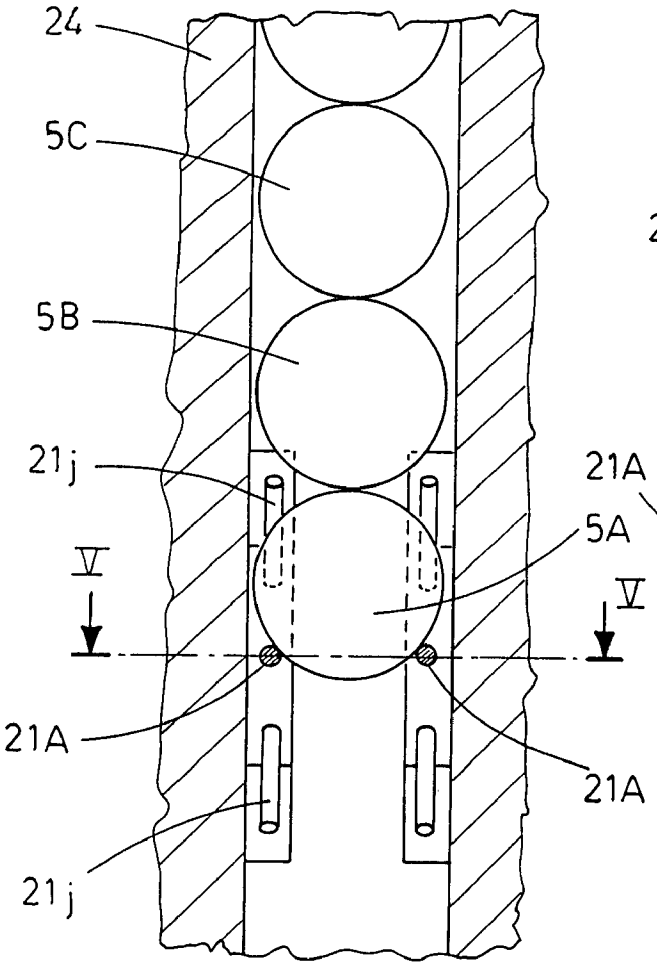
FIG. 4 is an enlarged, section view taken along the line IV-IV of FIG. 2.
Figure 6:
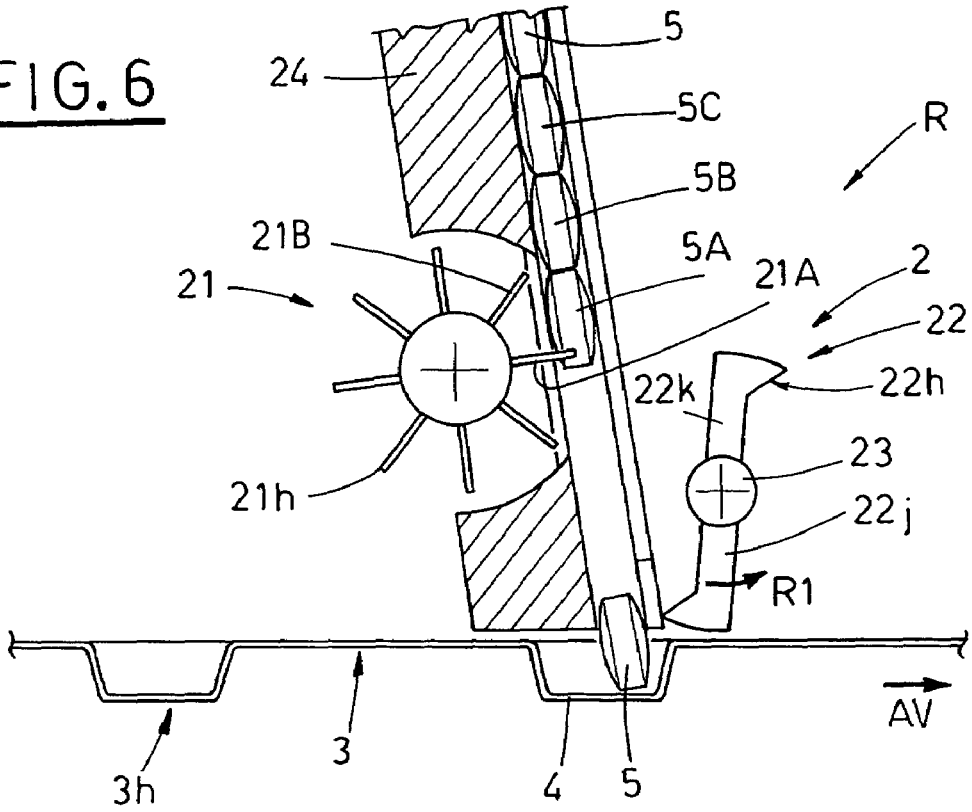
FIGS. 6, 7, 8, 10 are enlarged views of the device of FIG. 1, in as many significant work configurations.
Figure 7:
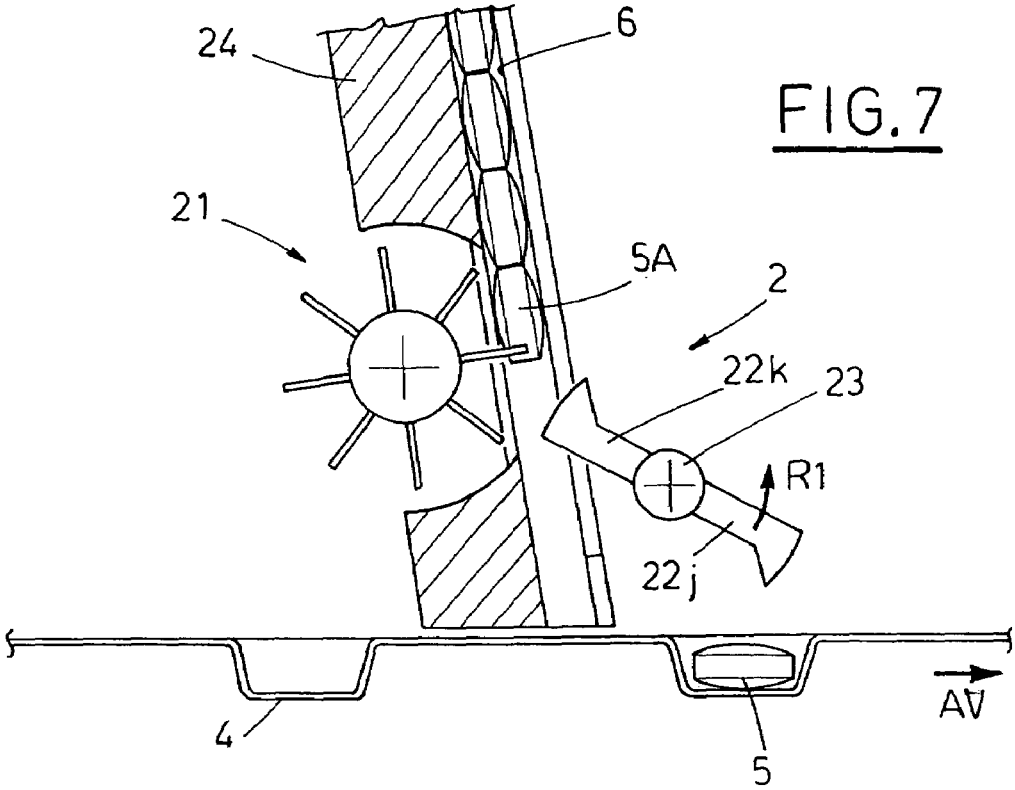

The device 2 includes, for each channel 6, a radial unit 21, having a plurality of radially extending needle-like elements 21*h*, 21A, 21B, each of which has a pair of spaced apart needles (FIGS. 4, 5, 9) and has axis perpendicular to the axis of the associated channel 6. The radial unit is operated e.g. stepwise by operating means (not shown) and is aimed at acting, as it will result clear from the following treatment, on the articles 5, 5A, 5B, 5C fed through the associated channel 6, so as to hold a given article 5, 5A, 5B, 5C and support those disposed thereabove.

A rotating element 22 is functionally interposed between the band 3 and each radial unit 21 and rotates about an axis parallel to the axis of the unit.

The radial unit 21 has for example two identical arms, a first arm 22*j* and a second arm 22*k*, perpendicular to the rotation axis and angularly equidistant, and are operated continuously by operating means, likewise not shown, as they are known.

The rotating element 22 and the radial unit 21 are driven in opposite rotation with respect to each other, i.e. in a first direction R1 and a second direction R2.

Moreover, the terminal portions of each arm 22*j*, 22*k* of each rotating element 22 form means 22*h*, capable of receiving an article 5, 5A, 5B, 5C released by the radial unit 21 and accompanying it, simultaneously with the rotation in the first direction R1, into a corresponding blister 4 of the blister band 3, in the way described later.

It is specified that each channel 6 extends up to the blister band 3 and has a longitudinal slit 30, which is wide less narrow than the articles 5, 5A, 5B, 5C.

The slit 30 faces the rotating element 22 so as to allow partial introduction of the arms 22*j*, 22*k* of the latter during the operation.

According to a preferred embodiment and in accordance with the enclosed Figures, all the rotating elements 22 are keyed onto a single shaft 23 rotated by the activating means.

The device 2 for feeding the blister band 3 with various articles 5, 5A, 5B, 5C, proposed by the invention, performs identical work cycles, each of which concludes filling of a series 3*h* of blisters 4 with articles 5, 5A, 5B, 5C.

Figure 2:
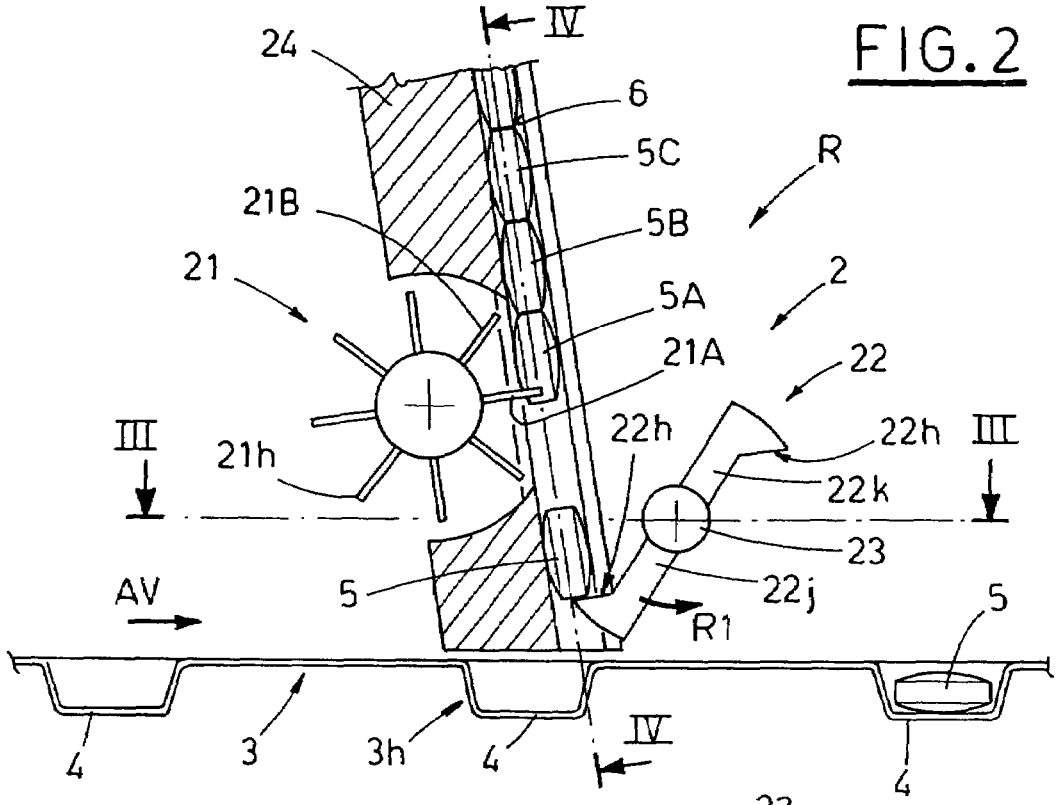
FIG. 2 is an enlarged view of the device of FIG. 1, in a first significant work configuration.

Moreover, the way of filling the blisters 4 is the same for each group including a channel 6 and the associated radial unit 21 and the rotating element 22, therefore later the working description will be referred to only a general cycle and group, in accordance with what has been shown in FIGS. 2 to 10: actually, if the work step schematized in FIG. 2 is taken as the beginning of a work cycle, FIGS. 6, 7, 8, 10 show the subsequent steps, until the end.

Figure 8:
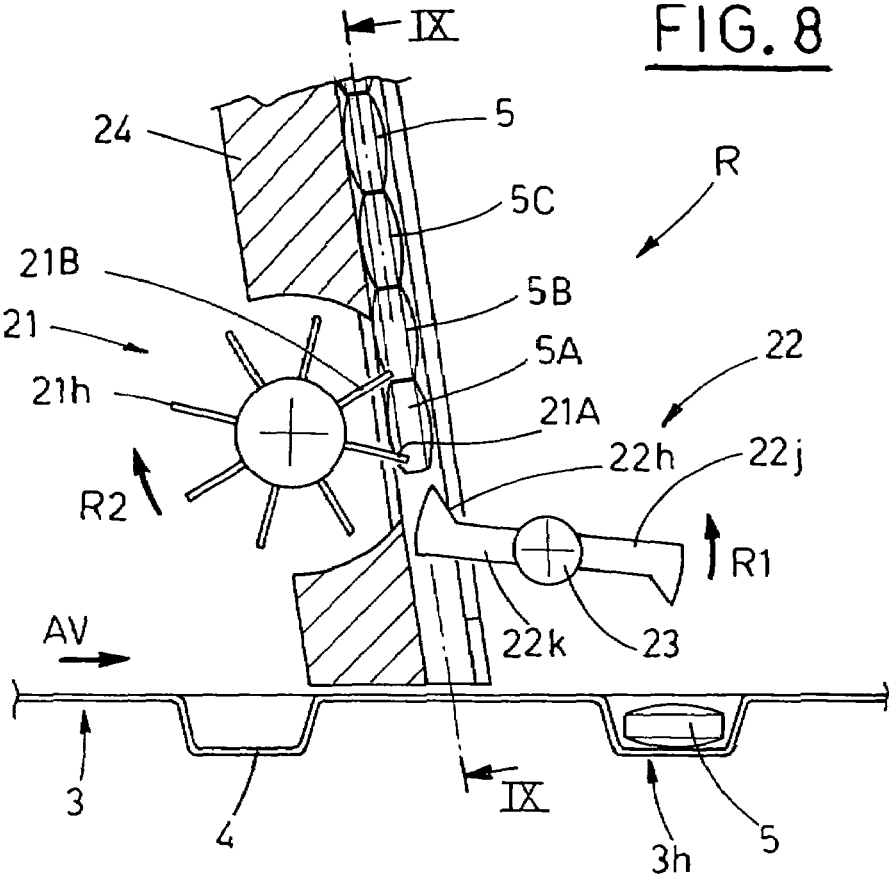
Figure 10:
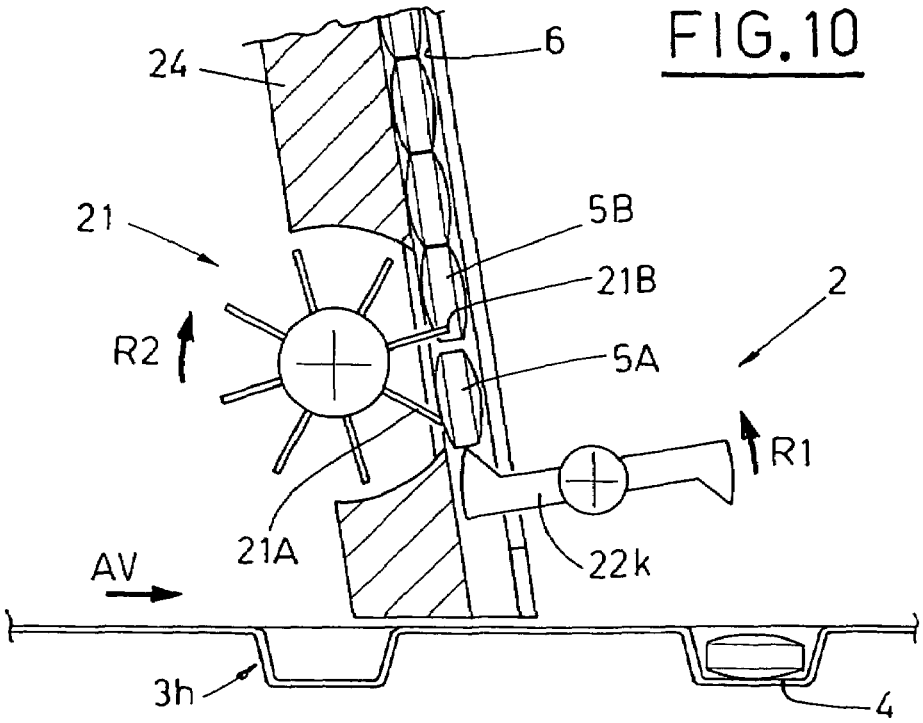

The radial unit 21 is operated stepwise in the rotation direction R2, in time relation with the operation of the rotating element 22 and at the end of the work cycle (FIGS. 8, 10).

In particular in the work configuration shown in FIG. 2, it is kept motionless and one of its needle-like elements 21A is situated below a first article 5A to hold it and to support the other ones above (respectively second article, third article, and so on) contained inside the associated channel 6.

Another article 5 is released by the radial unit 21 onto the support means 22*h*, for example of the first arm 22*j*, in the cycle preceding the one being considered, after relative rotation of the radial unit 21 by a prefixed angular step.

As it has been said, the rotating element 22 is keyed onto the shaft 23 and is operated continuously by actuating means, in step relation with the motion of the blister band 3.

The rotating element 22 receives, on the means 22*h*, the article 5 released by the radial unit 21 and accompanies it, simultaneously with its own rotation in the direction R1 into a corresponding blister 4 (FIGS. 2, 6, 7) of the passing band 3, without falls or pushes.

The release step for the first article 5A is shown in FIGS. 8, 10, and corresponds to the end of the operation cycle being considered.

The radial unit 21 is rotated by an angular step in the second rotation direction R2 to cause the insertion of a second needle-like element 21B, adjacent to the first needle-like element 21A, below the second article 5B, and the release of the first article 5A directly onto the support means 22*h* of the second arm 22*k*, which involve the channel 6 during their rotary movement.

Thus, the first article 5A is accompanied by the means 22*h* along the terminal portion of the channel 6, likewise guided by the conformation of the latter, into a corresponding blister 4 of the blister band 3, as described above.

The radial unit 21 is operated in precise step relation with the rotation of the arms 22*j*, 22*k* so as to cause a smooth release of the first article 5A onto the relative support means 22*h*, without falls or pushes, which could jeopardize its integrity.

The release without fall is possible due to the interaction of the pair of needles 21*j* of the first unit 21A with the support means 22*h*: actually, the reciprocal position of the needles 21*j* does not interfere with the support means 22*h* and their rotation by an angular step makes the first article 5A go to rest on the support means 22*h*, thus leaving them free (see FIG. 10).

Moreover, the usual conformation of the tablets (see for example also FIGS. 4, 9) allows a perfect insertion of the pair of needles 21*j* of the second needle-like element 21B below the second article 5B, without pushes, friction or any possible interference.

The forward speed of the blister band 3 and the tangential speed of the rotating element 22 are not only connected functionally (due to the step relation between the operation of the rotating element 22 and of the band 3), but they are also comparable so as to allow the article 5 to be introduced into the blister 4 without damages.

The operation of the radial unit 21 by one step causes the introduction of the second needle-like element 21B below the second article 5B and the release of the first article 5A.

Obviously, the beginning of the subsequent cycle (not shown) coincides with the situation shown qualitatively in FIG. 2; in fact, the radial unit 21 is motionless and holds the second article 5B supporting also the ones situated thereabove, contained inside the associated channel 6.

The rotation of the radial unit 21 by one angular step causes the gradual sliding, without leaps (as it happens in prior art) of the articles 5, 5C contained inside the associated channel 6, protecting their integrity also in this case.

The advantageous technical-functional features of the device 2 proposed by the invention allow also the partial filling of the blister band 3, according to the production needs (e.g. preparation of free or trial samples with a reduced number of tablets), after the deactivation of one or more radial units 21 for one or more work cycles.

Thus, the blister packs leaving the blistering machine 1 can contain a number of articles 5, 5A, 5B, 5C included between zero and the number of blisters 4 made therein.

The above description refers to the working of one of the groups of the device 2 for feeding the blister band 3, each of which includes a channel 6 and associated radial unit 21 and rotating element 22.

Figure 11:
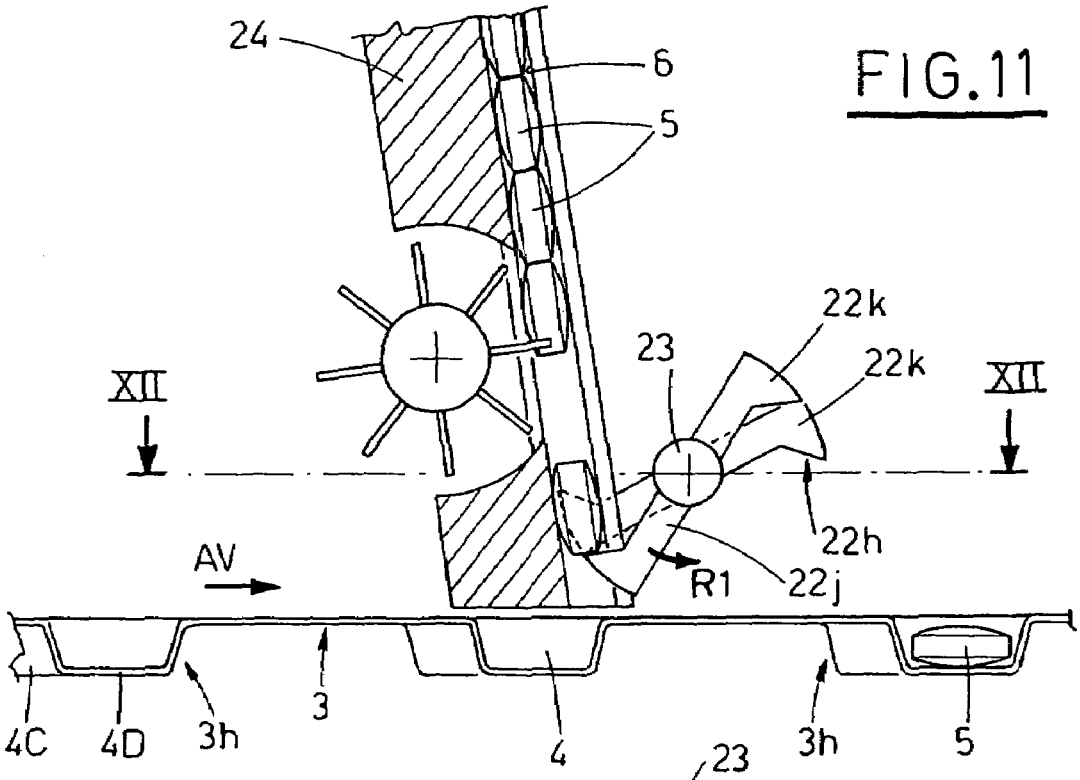
FIG. 11 is an enlarged view of the device of FIG. 1, in a significant work configuration and according to an embodiment.
Figure 12:
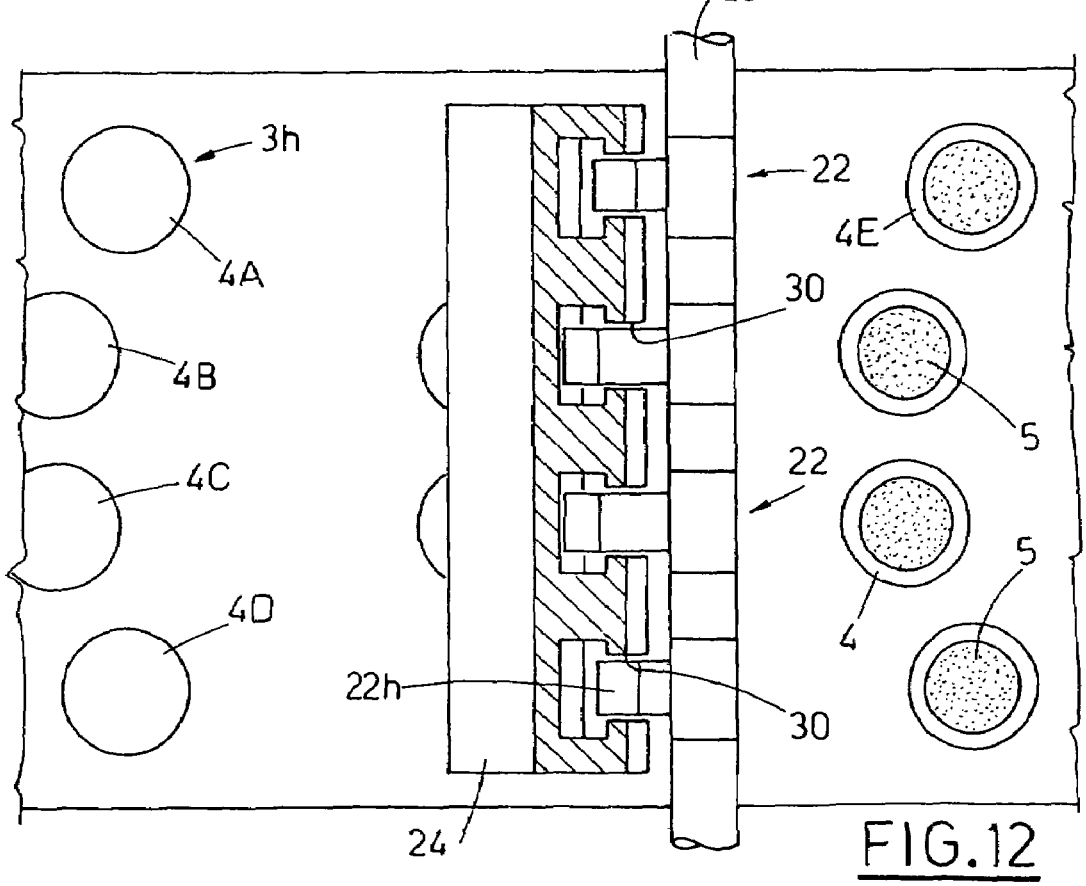
FIG. 12 is a section view taken along the line XII-XII of FIG. 11.

It results in a relative shift of the rotating elements 22 keyed onto the shaft 23 equal to or different from zero, depending respectively on the perfect alignment of the blisters 4 of each row 3*h*, as shown in FIGS. 2 to 10, or otherwise as in FIGS. 11, 12.

In the latter case, each blister 4A of a generic row 3*h* is offset with respect to the corresponding blister 4E of the adjacent row by a prefixed step and is situated upstream or downstream of the remaining blisters 4B, 4C, 4D of the same row 3*h* by prefixed distance, even zero (for example, between the blisters 4B, 4C), with respect to the forward direction AV.

In this sense, pairs of blisters 4B, 4C, belonging to the same row 3*h* of blisters 4A, 4B, 4C, 4D, aligned crosswise, correspond to associated rotating elements 22, all aligned, whereas pairs of blisters 4A, 4B, belonging to the same row 3*h* of blisters 4A, 4B, 4C, 4D, situated upstream or downstream with respect to the forward direction AV, correspond to associated rotating elements 22, angularly moved in relation to the prefixed step and by an angle corresponding to the mutual distance of the blisters 4A, 4B of the pair, considered along the longitudinal extension of the blister band.

The main advantage of the present invention lies in the fact that it has defined a device for feeding a blister band with various articles, such as pills, capsules, tablets, which is wholly compatible with all existing types of tablet products, from the most compact to the most friable, intended for cases, in which taking of the tablet medicines is difficult, for example children, elderly persons or persons suffering from particular pathologies.

Therefore, the so conceived technical solution resolves heavy technical drawbacks of the prior art devices, reported in the introductory note, working in optimal way with a wide range of articles, theoretically without rejected items and maintaining high production rate, functionality and reliability of the blistering machine, on which it is mounted.

A further advantage of the invention lies in the fact that it has conceived a device, which is extremely versatile and can be adapted to many kinds of blister bands, as it has already appeared from the description, from the ones having aligned rows of blisters, FIG. 3, to the ones, which have offset blisters, as shown as an indication in FIG. 12.

Another advantage of the invention lies in the fact that it has conceived a device for feeding a blister band with various articles, such as tablets, capsules, pills, whose cost is limited with respect to the obtained results.

What is claimed is:

1. A device for feeding articles into blisters of a blister band, the blister band driven in a prefixed feeding direction, said device comprising:

a plurality of channels situated above the band, each channel having a delivery end terminating in proximity to a blister for delivering an article thereto, said articles disposed one above another within each of said plurality of channels;

holding means associated with each channel for holding a bottom one of said articles disposed within the channel from below and thereby supporting articles situated above said bottom article, said holding means being operated to release said bottom article while simultaneously being operated to move under and below an article situated above the bottom article to hold the article;

receiving and releasing means associated with each channel and situated between said delivery end of each channel and said holding means for guiding each article passing through said channel to said delivery end, said receiving and releasing means receiving each article as each article is released by said holding means, and transporting each article as each article traverses the channel towards the delivery end, said received article then passed through the delivery end and delivered into the blister of said blister band, each received article resting directly on the receiving and releasing means and moving therewith, said receiving and releasing means being operated in step relation with said holding means and in coordination with the movement of said blister band in said feeding direction.

2. The device according to claim 1, wherein said receiving and releasing means include a rotating element arranged with a rotation axis perpendicular to an associated channel and operated in a first rotation direction in step relation with the movement of said blister band in said feeding direction, said rotating element having at least one arm located normal to said rotation axis and having support means at a terminal portion thereof, said support means supporting each article released by said holding and supporting means, and rotatably moving said article through said channel for delivery into a corresponding blister of said blister band through rotation of the rotating element in the first rotation direction.

3. The device according to claim 2, wherein each channel has a longitudinal slit with a width smaller than the width of said articles, the arms of the rotating element partially entering the channel through said slit to engage and support each article moving therethrough.

4. The device according to claim 2, further comprising actuating means for operating each rotating element in step relation with the movement of said blister band in said feeding direction.

5. The device according to claim 2, wherein each rotating element includes a plurality of identical arms angularly equidistant, each arm extending perpendicular to the rotation axis of the rotating element.

6. The device according to claim 5, further comprising actuating means for operating each rotating element in step relation with the movement of said blister band in said feeding direction.

7. A device according to claim 5, wherein each channel has a longitudinal slit with a width smaller than the width of said articles, the arms of the rotating element partially entering the channel through said slit to engage and support each article moving therethrough.

8. A device according to claim 7, further comprising actuating means for operating each rotating element in step relation with the movement of said blister band in said feeding direction.

9. A device, according to claim 5, wherein said rotating elements have at least one offset pair of arms associated with a channel for feeding an article to at least one blister offset from a row of blisters.

10. A device for feeding articles into blisters of a blister band, the blister band driven in a prefixed feeding direction, said device comprising:

a plurality of channels situated above the band, each channel having a delivery end terminating in proximity to a blister for delivering an article thereto, said articles disposed one above another within each of said plurality of channels;

holding means associated with each channel for holding a bottom one of said articles disposed within the channel from below and thereby supporting articles situated above said bottom article, said holding means being operated to release said bottom article while simultaneously being operated to move under and below an article situated above the bottom article to hold the article;

receiving and releasing means associated with each channel and situated between said delivery end of each channel and said holding means for guiding each article passing through said channel to said delivery end, said receiving and releasing means receiving each article as each article is released by said holding means, and transporting each article as each article traverses the channel towards the delivery end, said received article then passed through the delivery end and delivered into the blister of said blister band, each received article resting directly on the receiving and releasing means and moving therewith, said receiving and releasing means being operated in step relation with said holding means and in coordination with the movement of said blister band in said feeding direction, said receiving and releasing means including a rotating element arranged with a rotation axis perpendicular to an associated channel and operated in a first rotation direction in step relation with the movement of said blister band in said feeding direction, said rotating element having at least one arm located normal to said rotation axis and having support means at a terminal portion thereof for supporting each article released by said holding and supporting means; said support means supporting said article and rotatably moving said article through said channel for deposit into a corresponding blister of said blister band through rotation of the rotating element in the first rotation direction; and, wherein said holding and supporting means include a radial element rotated in a second rotation direction, opposite to said first rotation direction and arranged with a rotation axis parallel to said rotating element rotating axis, said holding and supporting means having a plurality of radially extending needle-like units, each having a pair of spaced apart needles, a first needle-like unit being positionable below said bottom article so as to hold said bottom article and support the articles disposed above the bottom article;

rotation of said radial element by a prefixed angular step, in said second direction, releasing said bottom article while locating a second needle-like unit into a position below said article situated above the bottom article, for holding said article and supporting the articles disposed above the said article.

11. A device, according to claim 10, further comprising actuating means for operating each radial element in step relation with the movement of said rotating element.

12. A device for feeding articles into blisters of a blister band, the blister band driven in a prefixed feeding direction, said device comprising:

a plurality of channels situated above the band, each channel having a delivery end terminating in proximity to a blister for delivering an article thereto, said articles disposed one above another within each of said plurality of channels;

holding means associated with each channel for holding a bottom one of said articles disposed within the channel from below and thereby supporting articles situated above said bottom article, said holding means being operated to release said bottom article while simultaneously being operated to move under and below an article situated above the bottom article to hold the article;

receiving and releasing means associated with each channel and situated between said delivery end of each channel and said holding means for guiding each article passing through said channel to said delivery end, said receiving and releasing means receiving each article as each article is released by said holding means, and transporting each article as each article traverses the channel towards the delivery end, said received article then passed through the delivery end and delivered into the blister of said blister band, each received article resting directly on the receiving and releasing means and moving therewith, said receiving and releasing means being operated in step relation with said holding means and in coordination with the movement of said blister band in said feeding direction;

said receiving and releasing means including a rotating element arranged with a rotation axis perpendicular to an associated channel and operated in a first rotation direction in step relation with the movement of said blister band in said feeding direction, said rotating element having at least one arm located normal to said rotation axis and having support means at a terminal portion thereof for supporting each article released by said holding and supporting means; said support means supporting said article and rotatably moving said article through said channel for deposit into a corresponding blister of said blister band through rotation of the rotating element in the first rotation direction;

wherein each rotating element includes a plurality of identical arms angularly equidistant, each arm extending perpendicular to the rotation axis of the rotating element;

said rotating elements having at least one offset pair of arms associated with a channel for feeding an article to at least one blister offset from a row of blisters, the at least one offset pair of arms being rotated by an angle in a direction either forward or backward in correspondence to the offset blister being situated upstream or downstream with respect to the row of blisters, and further rotated by an angle depending on a distance between the offset blister and the row of blisters.

* * * * *

UNITED STATES PATENT AND TRADEMARK OFFICE

CERTIFICATE OF CORRECTION

PATENT NO. : 7,591,122 B2
APPLICATION NO. : 11/584844
DATED : September 22, 2009
INVENTOR(S) : Giuseppe Monti It is certified that error appears in the above-identified patent and that said Letters Patent is hereby corrected as shown below:

On the title page, under item (22)
"Filed"

Insert

--Oct. 23, 2006--

Signed and Sealed this

Third Day of November, 2009

David J. Kappos

David J. Kappos
*Director of the United States Patent and Trademark Office*